US009133399B2

(12) United States Patent
Foulonneau

(10) Patent No.: US 9,133,399 B2
(45) Date of Patent: Sep. 15, 2015

(54) METHOD FOR REDUCING THE NAPHTHENIC ACIDITY OF PETROLEUM FEEDSTOCKS, AND USE THEREOF

(75) Inventor: Gregory Foulonneau, Le Havre (FR)

(73) Assignee: TOTAL RAFFINAGE MARKETING, Puteaux (FR)

( * ) Notice: Subject to any disclaimer, the term of this patent is extended or adjusted under 35 U.S.C. 154(b) by 960 days.

(21) Appl. No.: 13/322,798

(22) PCT Filed: May 28, 2010

(86) PCT No.: PCT/FR2010/051037

§ 371 (c)(1),
(2), (4) Date: Jan. 27, 2012

(87) PCT Pub. No.: WO2010/136738

PCT Pub. Date: Feb. 12, 2010

(65) Prior Publication Data

US 2012/0132568 A1 May 31, 2012

(30) Foreign Application Priority Data

May 29, 2009 (FR) ..... 09 53568

(51) Int. Cl.

| | |
|---|---|
| ***C10G 19/073*** | (2006.01) |
| *C10G 19/00* | (2006.01) |
| *C10G 19/08* | (2006.01) |
| *C10G 53/12* | (2006.01) |
| *C10G 67/10* | (2006.01) |

(52) U.S. Cl.

CPC ..... *C10G 19/073* (2013.01); *C10G 2300/107* (2013.01); *C10G 2300/1055* (2013.01); *C10G 2300/1077* (2013.01); *C10G 2300/203* (2013.01)

(58) Field of Classification Search

CPC ..... C10G 19/00; C10G 19/073; C10G 19/08; C10G 53/12; C10G 67/10

See application file for complete search history.

(56) References Cited

U.S. PATENT DOCUMENTS

| | | | | |
|---|---|---|---|---|
| 1,921,116 | A | 8/1933 | Caldwell | |
| 4,033,860 | A | 7/1977 | Carlson | |
| 5,904,839 | A | 5/1999 | Brons | |
| 6,679,987 | B1 * | 1/2004 | Blum et al. | 208/263 |
| 2002/0125175 | A1 * | 9/2002 | Collins et al. | 208/263 |

FOREIGN PATENT DOCUMENTS

EP 0 935 644 B1 2/2003

OTHER PUBLICATIONS

Nelson, W.L. (1941). Petroleum Refinery Engineering, 2nd ed., McGraw-Hill, 715 pgs [Office action cites p. 384].*

* cited by examiner

*Primary Examiner* — Brian McCaig
(74) *Attorney, Agent, or Firm* — Sughrue Mion, PLLC

(57) ABSTRACT

The invention relates to a method for reducing the naphthenic acidity of a petroleum feedstock having a neutralization index of 0.5 to 10 mg of KOH/g and a water content lower than 0.2 wt %, wherein said method comprises contacting the petroleum feedstock with a compound selected from the oxides, hydroxides and alkoxides of an HA group alkaline earth metal, the contact being carried out at a temperature lower than or equal to 150° C. The implementation of the method according to the invention, and in particular in the absence of water, makes it possible to reduce the naphthenic acidity and to prevent the formation of naphthenate salts that may subsequently reform naphthenic acids.

21 Claims, 1 Drawing Sheet

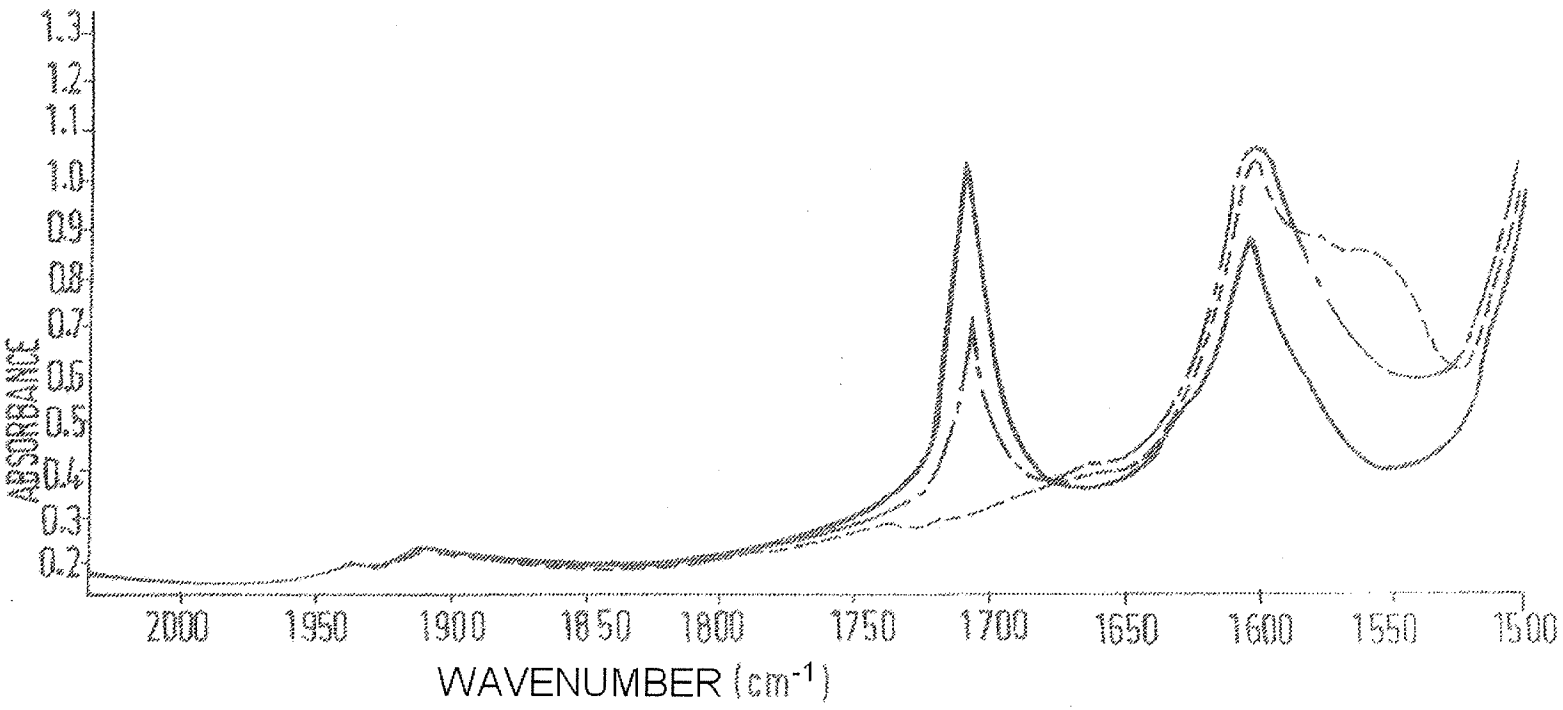
ABSORBANCE
1.3
1.2
1.1
1.0
0.9
0.8
0.7
0.6
0.5
0.4
0.3
0.2
2000
1950
1900
1850
1800
1750
1700
1650
1600
1550
1500
WAVENUMBER (cm-1)

METHOD FOR REDUCING THE NAPHTHENIC ACIDITY OF PETROLEUM FEEDSTOCKS, AND USE THEREOF

CROSS REFERENCE TO RELATED APPLICATIONS

This application is a National Stage of International Application No. PCT/FR2010/051037, filed on May 28, 2010, which claims priority from French Patent Application No. 09 53568, filed on May 29, 2009, the contents of all of which are incorporated herein by reference in their entirety.

The present invention relates to a process for reducing the naphthenic acidity of petroleum feedstocks, and the use thereof. More specifically, it relates to a process in which the naphthenic acidity is reduced by bringing said petroleum feedstock into contact with a compound chosen from oxides, hydroxides or alkoxides of a IIA alkaline-earth metal, at a temperature less than or equal to 150° C.

Crude oils that are referred to as "sour crude oils", that is to say having high contents of acids, are mainly those which contain naphthenic acids. Mention may, in particular, be made of heavy crude oils, the production of which is permanently increasing, and which are usually characterized by a high viscosity and a high naphthenic acidity.

The expression "naphthenic acids" is a generic term encompassing a mixture of organic acids present in the petroleum feedstocks.

It is known that these petroleum feedstocks, in particular crude oils, present risks of corrosion during their extraction from the oil field, their transport and during their refining.

Both oil exporters and refiners must find means of upgrading these crude oils without being obliged to develop novel technologies for protecting devices and equipment for transporting these crude oils or fractions thereof or else for treating the latter, whether at the field, in sea or railway transport, in the pipes or in the refinery.

This acidity of crude oils is conventionally measured by the total acid number (TAN) which is measured in accordance with the ASTM D664 standard via potentiometric analysis and with the D974 standard via colorimetry. The acidity may also be measured by infrared spectrometry. In this case it is referred to as TAN-IR, the acidity measured then corresponding solely to the contribution of the carboxylic acid function —COOH.

Generally, a discount is applied to crude oils as a function of the TAN number: the price of the crude oil depends on the value of this acidity.

Thus, it is necessary to develop a process for treating these crude oils, or fractions thereof, which makes it possible to reduce the acidity thereof. Indeed, such a process would make it possible not only to improve the safety of personnel and of equipment, but also to increase the refining margins and to limit the risks of corrosion that generate additional expenses in the event of the storage, transport or treatment equipment being perforated, especially in refineries.

Various approaches have been proposed in order to reduce the naphthenic acidity and therefore the corrosivity of crude oils:

- mixing crude oils having a high content of naphthenic acids with crude oils having a low content of naphthenic acids, in order to reduce the naphthenic acidity of the final mixture;
- use of corrosion inhibitors, such as those disclosed in patent EP 0 607 640;

- deacidification or neutralization of the petroleum feedstocks. Such a process was disclosed in patent EP 0 935 644.

As these approaches are not entirely satisfactory, there is still a need in the art to develop a process for deacidifying or neutralizing petroleum feedstocks.

Patent EP 0 935 644 specifically proposes a process for reducing the naphthenic acidity of petroleum feedstocks, in which a group IIA metal oxide, hydroxide or hydrate of hydroxide is added, in the presence of 0.2% to 7% by weight of water, this water being necessary so that the base added is effective in the neutralization of the acid. Even though a portion of the naphthenic acids disappears, naphthenates appear which are capable of reforming naphthenic acids subsequently, for example in the atmospheric distillation column, in which case the problem will only have been shifted instead of solved.

The present invention aims to overcome these drawbacks by proposing a process for reducing the naphthenic acidity of a petroleum feedstock having a neutralization number from 0.5 to 10 mg of KOH/g and a water content of less than 0.2% by weight, said process comprising a step of bringing the petroleum feedstock into contact with a compound chosen from oxides, hydroxides or alkoxides of an alkaline-earth metal from group HA, the contact being made at a temperature less than or equal to 150° C., said compound then being separated from the petroleum feedstock.

The Applicant has observed that the separation of the aforementioned group IIA metal oxide, hydroxide or hydrate of hydroxide, after being brought into contact with the petroleum feedstock, made it possible to reduce the rate of poisoning of the catalysts used during the refining and therefore to prolong the operating time of the plants without a maintenance shutdown.

The contacting step consists in sufficiently mixing the compound of a group IIA alkaline-earth metal with the petroleum feedstock so as to obtain a homogeneous mixture.

The Applicant has observed, surprisingly, that under such conditions, at least one portion of the naphthenic acids disappears, without naphthenates being formed.

Unlike the teaching from the prior art, and in particular from document EP 935 644, it is not necessary to add water in order to obtain the reduction of the acidity of the feedstock with the chosen compounds.

In particular, the process according to the invention enables a petroleum feedstock that contains no water to be treated.

Furthermore, the processes that exist in the prior art, such as those disclosed in documents WO 2006/14486, EP 924 285 and GB 496 779, require high temperatures in order to obtain a complete decarboxylation of the petroleum feedstock. On the contrary, the contacting step of the process according to the invention may be carried out at temperatures less than or equal to 150° C., preferably less than or equal to 100° C., more preferably less than or equal to 90° C. or 70° C.

These moderate temperatures thus make it possible to use devices for recovering the heat originating from the refinery streams in order to heat during the contacting step of the process according to the invention or to take advantage of steps for treating the crude petroleum feedstock that require heating.

For example, the process according to the invention will advantageously be carried out before the desalting of the petroleum feedstock, in order to take advantage of the heating produced at the inlet to the desalting. Furthermore, since the desalting is the step prior to the distillation of the crude oil, the implementation of the process of the invention before the desalting makes it possible to prevent the corrosion problems in the distillation units.

In one particularly advantageous embodiment, the contacting step may also be carried out at ambient temperature, thus making it possible to make energy savings.

Advantageously, the contacting step of the process according to the invention is carried out over a duration of at most 10 hours, preferably at most 30 minutes, and which is sufficient for the petroleum feedstock/group IIA alkaline-earth metal compound mixture to be homogeneous.

This homogenization of the mixture may be obtained in a relatively short time depending on the amounts mixed.

Advantageously, the amount of compound containing a group IIA metal used per mole of acid functionality in the petroleum feedstock is chosen from a range extending from 0.025 mol to 500 mol.

The compound containing a group IIA metal may be chosen from oxides, hydroxides and hydrates of hydroxides of calcium (Ca), of magnesium (Mg) and of barium (Ba), preferably calcium oxide CaO or magnesium oxide MgO.

Advantageously, the compound containing a group IIA metal is added in the form of a solid material, preferably in the form of a powder or of crushed grains.

There are thus no efforts to be made as regards the form of the compound added.

In particular, an addition in the form of crushed grains, such as pebbles, makes it possible to facilitate a subsequent separation, for example by filtration.

The petroleum feedstock could be chosen from crude oils, crude oils diluted by a solvent or a light cut resulting from the distillation of a crude oil, atmospheric residues and/or vacuum residues of crude distillations, gas oil and/or distillate cuts originating from the direct distillation of a crude oil or from various conversion processes such as catalytic cracking and visbreaking.

In a first embodiment, the contacting step of the process according to the invention may be carried out in at least one fixed-bed reactor, preferably in at least two fixed-bed reactors.

In particular, when two or more reactors are used, and when it is necessary to regenerate the compound of the group IIA metal or to change it in the reactor during use, it is possible to branch off toward another reactor during the regeneration or the changing of the compound.

In another embodiment, the contacting step is carried out in a feedstock tank, for example equipped with heating means.

Feedstock tanks, often equipped with stirring means, or even heating means, for example for heating to 45° C., are common in refineries, so that the process according to the invention may be carried out in existing tanks.

Advantageously, the compound of a group IIA metal is an oxide pretreated, for example by calcination, preferably from 800-1000° C. for 4 to 72 hours.

Such a pretreatment substantially improves the activity of the compound containing the metal.

Advantageously, a subsequent step of separating the compound containing the alkaline-earth metal is carried out, for example by filtration.

Such a separation step makes it possible to recover the compound based on a group IIA metal, and to thus prevent poisoning by the metals of the catalysts used in the catalytic refining processes.

The compound containing the alkaline-earth metal may be separated by a method chosen from filtration, centrifugation, distillation, settling and liquid/liquid extraction.

Preferably, the invention relates to a process for reducing the naphthenic acidity of a petroleum feedstock having a neutralization number from 0.5 to 10 mg of KOH/g and a water content of less than 0.2% by weight, said process comprising a step of bringing the petroleum feedstock into contact with CaO, the contact being made at a temperature less than or equal to 60° C. Indeed, it has been observed that CaO is the best candidate for a deacidification of a petroleum feedstock at ambient temperature, whereas MgO, which is a metal oxide having properties very similar to CaO, does not make it possible to obtain satisfactory results. The CaO is then advantageously separated from the petroleum feedstock, in order to prevent problems of poisoning of the catalyst bed or else of increasing the pressure difference between the inlet and the outlet of the reactors ("Delta P").

According to one preferred embodiment, the invention relates to a process for reducing the naphthenic acidity of a petroleum feedstock having a neutralization number from 0.5 to 10 mg of KOH/g and a water content of less than 0.2% by weight, said process comprising a step of bringing the petroleum feedstock into contact with CaO in crushed form, at a temperature between the pour point of the petroleum feedstock and 300° C. Indeed, it has been observed that the feedstock was well deacidified even when the nature of the CaO (crushed, therefore having a low specific surface area) appeared unfavorable to the reaction. The CaO is then advantageously separated from the petroleum feedstock, in order to prevent problems of poisoning of the catalyst bed or else of increasing the pressure difference between the inlet and the outlet of the reactors ("Delta P").

The pour point of the petroleum feedstock could be determined by methods known to a person skilled in the art. Use may, for example, be made of a manual tilt method according to the ASTM D97 standard (for petroleum products) or the ASTM D5853 standard (for crude oils) or an automated tilt method according to the ASTM D5950 standard, or a rotational method according to the ASTM D5985 standard, or else a pressure differential method according to the ASTM D7346 standard.

The feedstock does not appear to be destabilized by the CaO treatment under the operating conditions used. No precipitation of asphaltenes is observed. This makes the feedstock able to be used for mixing with other feedstocks such as heavy or light, sour or non-sour crudes. Such mixing may be carried out before desalting.

The invention is now described with reference to the non-limiting appended drawing, which represents the recording of the infrared spectrum of a crude petroleum feedstock (continuous line), of this feedstock treated according to the process of the invention (chain-dotted line) and of the same feedstock treated in the presence of water (broken line).

EXAMPLES

The process according to the invention was carried out with two types of petroleum feedstocks: a Dalia crude and a gas-oil cut, the properties of which are given in tables 1 and 2 below.

TABLE 1

Properties of Dalia crude oil

| | DALIA crude |
|---|---|
| Acidity (mg KOH/g) ASTM D664 | 1.7 |
| TAN-IR acidity | 0.94 |
| Density at 15° C. (kg/m$^3$) | 915 |

TABLE 1-continued

| Properties of Dalia crude oil | |
|---|---|
| | DALIA crude |
| Viscosity at 10° C. ($mm^2/s$) | 198 |
| Sulfur content (wt %) | 0.514 |
| Ni (ppm) | 17 |
| V (ppm) | 6 |
| Water content (%) NF-EN-ISO 10337 | 0.02 |

In order to carry out the tests, the gas-oil cut, the features of which are given in table 2, is acidified until a TAN-IR equal to around 4 is obtained by addition of 3-cyclohexanepropanoic acid, the boiling point of which is 275° C. This acid was chosen due to the similarities that it has with the naphthenic acids found in the petroleum cuts.

TABLE 2

| Properties of the gas-oil feedstock | |
|---|---|
| Density at 15° C. ($kg/m^{3)}$ | 840 |
| Acidity (mg KOH/g) ASTM 664 | 0 |
| TAN-IR acidity | 0 |
| Sulfur content (ppm) | 10 |
| Basic nitrogen content (ppm) | 7 |
| Cloud point (° C.) | −4 |
| Pour point (° C.) | −6 |
| Measured cetane number | 56 |
| Temperature for the distillation of | |
| 5% | 245.1 |
| 20% | 260.3 |
| 50% | 284.9 |
| 80% | 314.3 |
| 95% | 347.6 |
| of the gas oil (° C., ASTM 86) | |
| Bromine number (mg Br/100 g) | 621 |
| Content of polyaromatics (wt %) | 8.2 |
| Total content of aromatics (wt %) | 22.2 |
| Water content (%) NF-EN-ISO 10337 | 0 |

Implementation of the Tests

In a beaker or a round-bottomed flask, the petroleum feedstock is mixed with the calcium oxide CaO, which may or may not be calcined. Next, it is stirred for 15 minutes until homogenization, then the mixture is filtered through filter paper or through a frit in order to remove the calcium oxide. Finally, an infrared (IR) analysis is carried out in order to calculate the value of TAN-IR.

The acidity of the feedstocks is monitored by infrared spectrometry (TAN-IR). This technique makes it possible to determine the content of compounds of carboxylic acid type by monitoring the change in the absorption bands of the —COOH acid functional group (band extending from 1660 to 1751 $cm^{-1}$ and centered at around 1708 $cm^{-1}$).

In order to do this, a Thermo Nicolet 380 FTIR infrared spectrometer was used. The content of compounds of carboxylic acid type was determined from infrared spectra recorded by measuring the surface area of the peak relating to the —COOH acid function then by weighting it with the density of the product studied and also with the characteristics of the cell used.

The initial TAN-IR corresponds to the measurement of the starting product, before addition of CaO, whereas the final TAN-IR corresponds to the measurement of the mixture after filtration. The inaccuracy of the TAN-IR measurement is estimated at around 10%.

Example 1

In this example, the petroleum feedstock used is the acidified gas-oil cut, and the mixing is carried out at ambient temperature. The TAN IR measurements are given in table 3 below.

TABLE 3

| Acidified gas-oil cut-ambient temperature | | | | | |
|---|---|---|---|---|---|
| | CaO ratio (wt %) | mEq CaO/ mEq acid functionality | Initial TAN IR (mg KOH/g) | Final TAN IR (mg KOH/g) | Degree of deacid-ification |
| CaO calcined at 1000° C. for 24 hours | 5 | 18/0.7 | 4.07 | 1.69 | 58 |
| | 10 | 39/0.7 | 4.07 | 0.67 | 84 |
| | 20 | 72/0.6 | 4.00 | 0.46 | 88 |
| CaO calcined at 800° C. for 4 hours | 10 | 39/0.7 | 4.03 | 0.22 | 94 |
| Uncalcined CaO | 10 | 357/6.6 | 4.09 | 0.09 | 98 |

Example 2

In this example, the petroleum feedstock used is the Dalia crude, alone or diluted with the gas-oil cut, the properties of which are given in tables 1 and 2.

The mixing was carried out at ambient temperature and at 50° C.

The TAN IR measurements are given in table 4 below.

TABLE 4

| Dalia crude, alone or diluted | | | | | | | |
|---|---|---|---|---|---|---|---|
| | | T° | CaO ratio (wt %) | mEq CaO/mEq acid functionality | Initial TAN IR (mg KOH/g) | Final TAN IR (mg KOH/g) | Degree of deacidification |
| Dalia crude diluted with 50 wt % of gas oil | Uncalcined CaO | Ambient | 10 | 185/0.5 | 0.58 | 0.36 | 38 |

TABLE 4-continued

| Dalia crude, alone or diluted | | | | | | | |
|---|---|---|---|---|---|---|---|
| | | T° | CaO ratio (wt %) | mEq CaO/mEq acid functionality | Initial TAN IR (mg KOH/g) | Final TAN IR (mg KOH/g) | Degree of deacidification |
| Dalia crude diluted with 50 wt % of gas oil | CaO calcined at 1000° C. for 24 hours | Ambient | 20 | 714/0.8 | 0.58 | 0.17 | 71 |
| Dalia crude | Uncalcined CaO | Ambient | 10 | 357/1.5 | 0.94 | 0.49 | 48 |
| Dalia crude | CaO calcined at 1000° C. for 24 hours | Ambient | 10 | 35.7/0.1 | 0.94 | 0.33 | 64 |
| Dalia crude | CaO calcined at 1000° C. for 12 hours | 50° C. | 20 | 160/0.3 | 0.94 | 0.43 | 54 |

Example 3

In this example, the Dalia crude to which 10% by weight of uncalcined CaO had been added was tested with an addition of 6% by weight of water relative to the weight of the crude only. The infrared spectrum of the filtered mixture was recorded after filtration and is given in the sole FIGURE.

In this FIGURE, the infrared spectrum of the untreated Dalia crude and of the Dalia crude/10% by weight of CaO mixture after filtration, but free of water, is also represented.

In the FIGURE:

- the graph with the broken line (graph 1) corresponds to the Dalia crude+10 wt % CaO+6 wt % of water;
- the graph with the chain-dotted line (graph 2) corresponds to the Dalia crude+10 wt % CaO—free of water;
- the graph with the continuous line (graph 3) corresponds to Dalia crude alone.

On graph 1, the disappearance of the peak of the acid function, in particular of the C═O bond (band extending from 1660 to 1751 $cm^{-1}$ and centered at about 1708 $cm^{-1}$) and the appearance of the peak corresponding to naphthenates (broad band between 1520 and 1580 $cm^{-1}$, centered at 1560 $cm^{-1}$) will be observed. The peak of 1600 $cm^{-1}$ itself appears to correspond to the C═C bond.

On graph 2, the acid function peak has decreased, corresponding to a reduction of the acidity of the crude treated, but no peak corresponding to naphthenates has appeared.

It is thus observed that the implementation of the process according to the invention, and in particular the absence of water, makes it possible not only to reduce the naphthenic acidity (the peak corresponding to the acid function decreases), but also to prevent the formation of naphthenate salts.

Example 4

3-Cyclohexylpropanoic acid (which is a naphthenic acid) is added to gas oil resulting from a DHC unit (Distillate HydroCracking unit: process of hydrocracking distillates under vacuum), so that the TAN is equal to 4. CaO is added to the mixture according to the process described above for the implementation of the tests. The results are presented in table 5 below. The experiment is carried out at ambient temperature.

TABLE 5

Variation of the deacidification of a gas oil resulting from DHC having TAN IR adjusted to 4 using 3-cyclohexylpropanoic acid when the proportions of powdered CaO vary

| DHC gas oil + 3-cyclohexyl-propanoic acid (g) | Initial TAN IR (mg KOH/g) | Final TAN IR (mg KOH/g) | CaO (wt %) | Degree of deacidification |
|---|---|---|---|---|
| 10 | 4.066 | 1.113 | 2 | 27 |
| 10 | 4.066 | 1.063 | 2 | 26 |
| | | | | Average 27 |
| 10 | 4.066 | 1.689 | 5 | 58 |
| 10 | 4.066 | 1.894 | 5 | 53 |
| | | | | Average 56 |
| 10 | 4.029 | 0.149 | 10 | 96 |
| 10 | 4.029 | 0.222 | 10 | 94 |
| 10 | 3.676 | 0.559 | 10 | 85 |
| 10 | 3.676 | 0.583 | 10 | 84 |
| 10 | 4.066 | 0.663 | 10 | 84 |
| 10 | 4.066 | 0.833 | 10 | 80 |
| | | | | Average 87 |
| 10 | 4.029 | 0.010 | 20 | 100 |
| 10 | 4.029 | 0.037 | 20 | 99 |
| 10 | 3.676 | 0.327 | 20 | 91 |
| 10 | 3.676 | 0.461 | 20 | 87 |
| 10 | 3.676 | 0.696 | 20 | 81 |
| 100 | 3.851 | 0.820 | 20 | 79 |
| | | | | Average 90 |

A strong deacidification at low temperature is observed in the presence of CaO. This increases with the amount of CaO added.

Example 5

3-Cyclohexylpropanoic acid is added to gas oil resulting from a DHC unit so that the TAN is equal to 4. CaO or MgO is added to the mixture according to the process described above for the implementation of the tests. The experiment is carried out at ambient temperature. The results are presented in table 6 below.

TABLE 6

Variation of the deacidification of a gas oil resulting from DHC having TAN IR adjusted to 4 using 3-cyclohexylpropanoic acid when proportions of powdered CaO or MgO vary

| Test number | 1 | 2 | 3 | 4 |
|---|---|---|---|---|
| Nature of the feedstock | DHC gas oil + 3-cyclohexylpropanoic acid | DHC gas oil + 3-cyclohexylpropanoic acid | Dalia crude | Dalia crude |
| Weight of the feedstock (g) | 100 | 50 | 100 | 100 |
| Metal oxide used and calcination time (minutes) | Uncalcined CaO | Uncalcined MgO | Uncalcined CaO | Uncalcined MgO |
| Wt % of metal oxide relative to the feedstock | 10 | 10 | 10 | 10 |
| Form | Powder | Powder | Powder | Powder |
| Stirring speed (rpm) | 9500 | 9500 | 9500 | 9500 |
| Stirring time (min) | 3 | 15 | 15 | 15 |
| Temperature (° C.) | 25.5 | 25.5 | 35.6 | 35.6 |
| Initial TAN IR (mg KOH/g) | 4.09 | 4.09 | 0.94 | 0.94 |
| Final TAN IR (mg KOH/g) | 0.11 | 3.66 | 0.49 | 0.92 |
| Degree of deacidification | 97.3 | 9 | 52 | 2 |

MgO is unsuitable for carrying out a deacidification of a crude oil at ambient temperature under the operating conditions used. CaO allows a significant and rapid deacidification. In 3 minutes, a gas oil feedstock resulting from DHC, to which 3-cyclohexylpropanoic acid has been added in order to attain a TAN-IR=4, is 97% deacidified (test 1) whereas an identical feedstock treated with MgO is only deacidified to a level of 9% after 15 minutes (test 2). Similarly, a Dalia crude oil feedstock having an initial TAN-IR=0.94 is 52% deacidified in 15 minutes in the presence of CaO (test 3), whereas the same feedstock treated under identical conditions in the presence of MgO instead of CaO is only deacidified by 2% (test 4).

Example 6

Dalia crude is brought into contact with CaO in different forms. The contact temperature, the proportion of CaO and its particle size and also the dilution of Dalia with gas oil are among the variables measured. The results are presented in table 7 below.

TABLE 7

Variation of the deacidification of Dalia crude as a function of the nature of the CaO, of its proportions in the mixture and of the temperature

| | | T° | CaO ratio (wt %) | mEq CaO/mEq acid functionality | Initial TAN IR (mg KOH/g) | Final TAN IR (mg KOH/g) | Degree of deacidification |
|---|---|---|---|---|---|---|---|
| Dalia crude diluted with 50 wt % of gas oil | Uncalcined CaO | Ambient | 10 | 185/0.5 | 0.58 | 0.36 | 38 |
| Dalia crude diluted with 50 wt % of gas oil | CaO calcined at 1000° C. for 24 hours | Ambient | 20 | 714/0.8 | 0.58 | 0.17 | 71 |
| Dalia crude | Uncalcined CaO | Ambient | 10 | 357/1.5 | 0.94 | 0.49 | 48 |
| Dalia crude | CaO calcined at 1000° C. for 24 hours | Ambient | 10 | 35.7/0.1 | 0.94 | 0.33 | 64 |

TABLE 7-continued

| Variation of the deacidification of Dalia crude as a function of the nature of the CaO, of its proportions in the mixture and of the temperature | | | | | | | |
|---|---|---|---|---|---|---|---|
| | | T° | CaO ratio (wt %) | mEq CaO/mEq acid functionality | Initial TAN IR (mg KOH/g) | Final TAN IR (mg KOH/g) | Degree of deacidification |
| Dalia crude | CaO calcined at 1000° C. for 12 hours | 50° C. | 20 | 160/0.3 | 0.94 | 0.43 | 54 |

The ambient temperature may customarily vary between −10 and +50° C. In the location where the measurements were made, it is generally between +5 and +40° C., with an average temperature between +15 and +25° C.

It is observed that CaO makes it possible to significantly decrease the acidity of the crude between ambient temperature and 50° C. The measurement of the final TAN IR indicates a reduction in the proportion of carboxylic acid functions in the crude which are not found in the form of alkaline-earth metal (here calcium) carboxylates.

The invention claimed is:

1. A process for reducing the naphthenic acidity of a petroleum feedstock having a neutralization number from 0.5 to 10 mg of KOH/g and a water content of less than 0.2% by weight, said process comprising a step of bringing the petroleum feedstock into contact with a compound chosen from oxides, of an alkaline-earth metal from group IIA, the contact being made at a temperature less than or equal to 150° C., without addition of water before or during the contact, said compound then being separated from the petroleum feedstock.

2. The process for reducing the naphthenic acidity of a petroleum feedstock as claimed in claim 1, in which the petroleum feedstock contains no water.

3. The process for reducing the naphthenic acidity of a petroleum feedstock as claimed in claim 1, in which the contacting step is carried out over a duration of at most 10 hours, and which is sufficient for the petroleum feedstock/group IIA alkaline-earth metal compound mixture to be homogeneous.

4. The process for reducing the naphthenic acidity of a petroleum feedstock as claimed in claim 3, in which the contacting step is carried out over a duration of at most 30 minutes.

5. The process as claimed in claim 1, in which the amount of compound containing a group IIA metal used per mole of acid functionality in the petroleum feedstock is chosen from a range extending from 0.025 mol to 500 mol.

6. The process as claimed in claim 1, in which the compound containing a group IIA metal is chosen from oxides of calcium (Ca), of magnesium (Mg) and of barium (Ba).

7. The process as claimed in claim 6, in which the compound containing a group IIA metal is calcium oxide CaO or magnesium oxide MgO.

8. The process as claimed in claim 1, in which the compound containing a group IIA metal is added in the form of a solid material.

9. The process as claimed in claim 8, characterized in that the solid material is in the form of a powder or of crushed grains.

10. The process as claimed in claim 1, in which the petroleum feedstock is chosen from crude oils, crude oils diluted by a solvent or a light cut resulting from the distillation of a crude oil, atmospheric residues and/or vacuum residues of crude distillation, gas oil and/or distillate cuts originating from the direct distillation of a crude oil or from various conversion processes such as catalytic cracking and visbreaking.

11. The process as claimed in claim 1, in which the contacting step is carried out in at least one fixed-bed reactor.

12. The process as claimed in claim 11, in which the contacting step is carried out in two fixed-bed reactors.

13. The process as claimed in claim 1, in which the contacting step is carried out in a feedstock tank, optionally equipped with heating means.

14. The process as claimed in claim 1, in which the compound of a group IIA metal is an oxide pretreated via calcination.

15. The process as claimed in claim 14, in which the calcination takes place at a temperature between 800 and 1000° C. for 4 to 72 hours.

16. The process as claimed in claim 1, in which the separation of the compound containing the alkaline-earth metal is chosen from filtration, centrifugation, distillation, settling and liquid/liquid extraction.

17. The use of the process as claimed in claim 1, characterized in that the petroleum feedstock is a crude oil and in that said process is used before a desalting step.

18. A process for reducing the naphthenic acidity of a petroleum feedstock having a neutralization number from 0.5 to 10 mg of KOH/g and a water content of less than 0.2% by weight, said process comprising a step of bringing the petroleum feedstock into contact with CaO, the contact being made at a temperature less than or equal to 60° C.

19. A process for reducing the naphthenic acidity of a petroleum feedstock having a neutralization number from 0.5 to 10 mg of KOH/g and a water content of less than 0.2% by weight, said process comprising a step of bringing the petroleum feedstock into contact with CaO in crushed form, at a temperature between the pour point of the petroleum feedstock and 300° C.

20. The process as claimed in claim 18, characterized in that the CaO is then separated from the petroleum feedstock.

21. The process as claimed in claim 20, in which the separation is chosen from filtration, centrifugation, distillation, settling and liquid/liquid extraction.

* * * * *